US008230705B2

(12) United States Patent
Kim

(10) Patent No.: US 8,230,705 B2
(45) Date of Patent: Jul. 31, 2012

(54) FLUID DETERGENT AND FABRIC SOFTENER BOX ASSEMBLY FOR LAUNDRY MACHINE AND DETERGENT DISPENSER HAVING THE SAME

(75) Inventor: Bo Yeon Kim, Jinju-si (KR)

(73) Assignee: LG Electronics Inc., Seoul (KR)

( * ) Notice: Subject to any disclaimer, the term of this patent is extended or adjusted under 35 U.S.C. 154(b) by 407 days.

(21) Appl. No.: 12/537,769

(22) Filed: Aug. 7, 2009

(65) Prior Publication Data

US 2010/0095712 A1 Apr. 22, 2010

(30) Foreign Application Priority Data

Oct. 17, 2008 (KR) ..... 10-2008-0102232

(51) Int. Cl.
*D06F 29/00* (2006.01)
*D06F 35/00* (2006.01)

(52) U.S. Cl. ..... 68/12.18; 68/17 R

(58) Field of Classification Search ..... 68/17 R, 68/12.18
See application file for complete search history.

(56) References Cited

U.S. PATENT DOCUMENTS

| | | | | |
|---|---|---|---|---|
| D435,151 | S * | 12/2000 | Schober | D32/25 |
| 2003/0145633 | A1* | 8/2003 | Merkle et al. | 68/17 R |
| 2004/0172770 | A1* | 9/2004 | Heo et al. | 8/158 |
| 2005/0229652 | A1* | 10/2005 | Kim et al. | 68/237 |
| 2005/0274157 | A1* | 12/2005 | Yang | 68/17 R |
| 2007/0056330 | A1* | 3/2007 | Song | 68/17 R |

* cited by examiner

*Primary Examiner* — Michael Barr
*Assistant Examiner* — Charles W Kling
(74) *Attorney, Agent, or Firm* — Birch, Stewart, Kolasch & Birch, LLP

(57) ABSTRACT

A fluid detergent and fabric softener box assembly which can be attached and detached to/from a detergent supply apparatus, and temporarily stores a fluid detergent and a fabric softener until they are selectively introduced into a washing room in water supply is provided.

15 Claims, 12 Drawing Sheets

FLUID DETERGENT AND FABRIC SOFTENER BOX ASSEMBLY FOR LAUNDRY MACHINE AND DETERGENT DISPENSER HAVING THE SAME

BACKGROUND OF THE INVENTION

1. Field of the Invention

The present invention relates to a detergent supply apparatus for a laundry machine, and more particularly to, a fluid detergent and fabric softener box assembly which can be attached and detached to/from a detergent supply apparatus, and temporarily stores a fluid detergent and a fabric softener until they are selectively introduced into a washing room in water supply, and a detergent dispenser having the same.

2. Description of the Related Art

In general, a drum laundry machine is installed such that an outer circumferential surface of a cylindrical washing drum is positioned in the up-down direction, and washes laundry in a beat-wash manner using a fall head produced when the washing drum rotates. The drum laundry machine roughly includes a main body forming the exterior appearance, a tub installed in the main body and filled with wash water, and a washing drum rotatably installed in the tub with a plurality of dehydration holes on its wall surface. In addition, a detergent supply apparatus which dissolves a detergent using wash water supplied from an outer water supply source to the inside of the washing drum, and supplies the wash water mixed with the detergent to the inside of the washing drum is installed on the upper side of the tub. Therefore, the drum laundry machine can automatically perform several washing processes such as primary washing, main washing, rinsing, bleaching and dehydration under the control of a control unit by a user's manipulation, and perform various washing processes by supplying a detergent or a fabric softener necessary for each washing process to the inside of the wash tub.

FIG. 1 is a perspective view illustrating a state where a detergent container of a detergent supply apparatus installed in a general drum laundry machine is taken out, and FIG. 2 is a schematic vertical-sectional view illustrating a structure of the detergent supply apparatus shown in FIG. 1. The detergent supply apparatus of the general drum laundry machine will be described with reference to the above drawings.

The detergent supply apparatus of the general drum laundry machine includes a detergent container housing 30 coupled to one side of an upper portion of a front surface of a main body 10 of the drum laundry machine, a detergent container 40 provided with a receiving groove which can receive a detergent, and installed in the detergent container housing 30 to be taken out, and a dispenser 20 for water supply which supplies wash water to the detergent container 40. In order to use the laundry machine with the above construction, as illustrated in FIG. 1, a user takes out some portion of the detergent container 40 toward the front surface of the main body 10 of the drum laundry machine, puts a detergent and a fabric softener in respective detergent receiving portions separated and partitioned in the detergent container 40, pushes the detergent container 40 into the detergent container housing 30, and operates the laundry machine.

When the laundry machine is operated, respective washing processes are performed under the control of a control unit. A water supply valve 11 is opened, so that wash water is supplied to the inside of the drum laundry machine. The wash water supplied to the inside of the drum laundry machine is supplied to the dispenser 20 for water supply through a connection hose. The wash water supplied to the dispenser 20 for water supply is introduced into the detergent container 40 positioned therebelow, mixed with the detergent or the fabric softener, and supplied to the inside of a tub 50 through a water supply hose 12.

Meanwhile, the detergent container 40 of the detergent supply apparatus described above is constructed such that the detergent and the fabric softener are dissolved by the wash water supplied to the inside thereof, and supplied to the inside of the tub 50 during a washing process. Here, the detergent remains in the detergent container 40. As the above process is repeated, the residual detergent is accumulated in the detergent container 40. Therefore, a cleaning task is required to remove the detergent residues in every certain period.

However, the detergent container 40 is not completely separated from the detergent container housing 30, but partially taken out to the front of the main body 10 by a defined width. It is thus very difficult for the user to do the cleaning task for removing the detergent residues. Moreover, when the user takes out the detergent container 40 to the front of the main body 10, puts the detergent or the fabric softener in the detergent container 40, and pushes the detergent container 40 into the detergent container housing 30, the detergent or the fabric softener may flow over the detergent container 40. Accordingly, the user must carefully put the detergent and the fabric softener in the detergent container 40, which causes inconvenience in use.

In the meantime, with diversification and functionality improvement of the detergent, not only a powder washing detergent formed of fine particles but also a fluid washing detergent formed in a liquid phase has been increasingly used. In this aspect, since the detergent supply apparatus described above supplies a powder washing detergent, and a liquid-phase fabric softener and bleaching agent to the inside of a washing space, it can supply only the powder washing detergent to the inside of the washing space during a washing stroke composed of primary washing and main washing. However, the detergent supply apparatus is not provided with a fluid detergent supply means which can separately supply a liquid-phase washing detergent to perform not bleaching and rinsing functions but a washing function. As a result, there is limitation on satisfying functionality by the user's various demands.

SUMMARY OF THE INVENTION

Therefore, an object of the present invention is to provide a fluid detergent and fabric softener box assembly which can prevent a fluid detergent and a fabric softener from being mixed with each other in water supply, or prevent bubbles of the fluid detergent from overflowing into the fabric softener side.

Another object of the present invention is to provide a fluid detergent and fabric softener box assembly which can maximize a siphon effect in a fluid detergent and fabric softener box to prevent a fluid detergent and a fabric softener from remaining in the fluid detergent and fabric softener box.

A further object of the present invention is to provide a fluid detergent and fabric softener box assembly which can be easily attached and detached for easy cleaning.

According to an aspect of the present invention, a fluid detergent and fabric softener box assembly includes: a main body partitioned by a barrier to store a fluid detergent and a fabric softener; and a cap partitioned by a barrier, and attached and detached to/from an upper portion of the main body.

In addition, preferably, the main body includes a pipe capable of discharging each mixed water, in which water supplied to the rear is mixed with the fluid detergent and the fabric softener, into a washing room.

Moreover, preferably, a bottom end of the pipe of the main body is positioned lower than bottom surfaces of storages spaces into which the fluid detergent and the fabric softener are introduced.

Further, preferably, the cap includes a pipe cover which covers an upper portion of the pipe at a defined interval from the pipe.

Furthermore, preferably, water used to produce the fluid detergent mixed water and the fabric softener mixed water is supplied to open side surfaces at the rear of the cap which are not covered with the pipe cover.

Still furthermore, preferably, the barrier of the cap includes a groove so that the barrier of the main body can be inserted thereinto.

Still furthermore, preferably, a stepped portion is formed between a front portion and a rear portion of the cap, and the front portion of the cap is higher than the rear portion thereof.

Still furthermore, preferably, a seating protrusion is formed at the front of the cap so that a front portion of the main body can be fitted thereto.

Still furthermore, preferably, a fixing hook is provided at the rear of the cap, and a fixing protrusion which fixes the fixing hook is provided at the rear of the main body.

According to another aspect of the present invention, a detergent dispenser for a drum laundry machine includes: a dispenser cover which is formed by coupling a dispenser lower cover to a dispenser upper cover, and includes a region into which a main washing detergent is introduced, a region on which a fluid detergent and fabric softener box assembly is mounted, and a region into which a primary washing detergent is introduced; and the fluid detergent and fabric softener box assembly which is detachably coupled to the dispenser cover.

In addition, preferably, the dispenser lower cover includes a water supply inlet through which water is supplied from the outside, a drainage hole which supplies water to each region, a passage which guides water supplied to each drainage hole, and a distribution rib which distributes water to each passage, wherein a height of an endmost portion of an end of the distribution rib on the side of the water supply inlet is restricted to within 3.5 mm, and the height smoothly and gradually increases from the endmost portion to about 15 mm.

Moreover, preferably, the dispenser lower cover includes a fluid detergent-side drainage hole and a fabric softener-side drainage hole in the region on which the fluid detergent and fabric softener box assembly is mounted, and also includes a plurality of ribs between the respective drainage holes.

Further, preferably, the dispenser lower cover includes a fluid detergent-side drainage hole and a fabric softener-side drainage hole in the region on which the fluid detergent and fabric softener box assembly is mounted, and also includes a rib for guiding water around each drainage hole.

Furthermore, preferably, the fluid detergent and fabric softener box assembly includes a barrier which separates a fluid detergent storage space from a fabric softener storage space.

Still furthermore, preferably, the dispenser lower cover includes a groove so that the barrier can be inserted thereinto.

Still furthermore, preferably, the fluid detergent and fabric softener box assembly includes: a main body having a fluid detergent storage space and a fabric softener storage space; and a cap which is attached and detached to/from the main body, and covers an upper portion of the main body.

Still furthermore, preferably, a stepped portion is formed between a front portion and a rear portion of the cap, and the front portion is higher than the rear portion.

Still furthermore, preferably, the dispenser upper cover includes a rib so that the front portion of the cap can be hooked thereon and fixed thereto, when the fluid detergent and fabric softener box assembly is coupled to the dispenser cover.

Still furthermore, preferably, when the fluid detergent and fabric softener box assembly is coupled to the dispenser cover, the rear portion of the cap is positioned below the dispenser lower cover.

Therefore, since the fluid detergent and fabric softener box assembly for the drum laundry machine provided by the present invention is detachably formed, the user can separate the box assembly from the dispenser and clean the box assembly, thereby maintaining cleanliness.

In addition, since the main body and the cap which constitute the fluid detergent and fabric softener box assembly can be separated from each other, the user can easily clean the pipe or the pipe cover for bringing the siphon effect.

Moreover, the fluid detergent and fabric softener box assembly for the drum laundry machine provided by the present invention can considerably prevent the fluid detergent and the fabric softener from being splashed into another storage space due to a fall head of water in preparation of mixed water, or prevent bubbles which may be generated in preparation of fluid detergent mixed water from overflowing into a fabric softener storage space.

BRIEF DESCRIPTION OF THE DRAWINGS

The above and other objects, features and advantages of the present invention will become apparent from the following description of a preferred embodiment given in conjunction with the accompanying drawings, in which.

DESCRIPTION OF THE PREFERRED EMBODIMENT

Hereinafter, the present invention will be described in detail with reference to an embodiment and the accompanying drawings.

Figure 1:
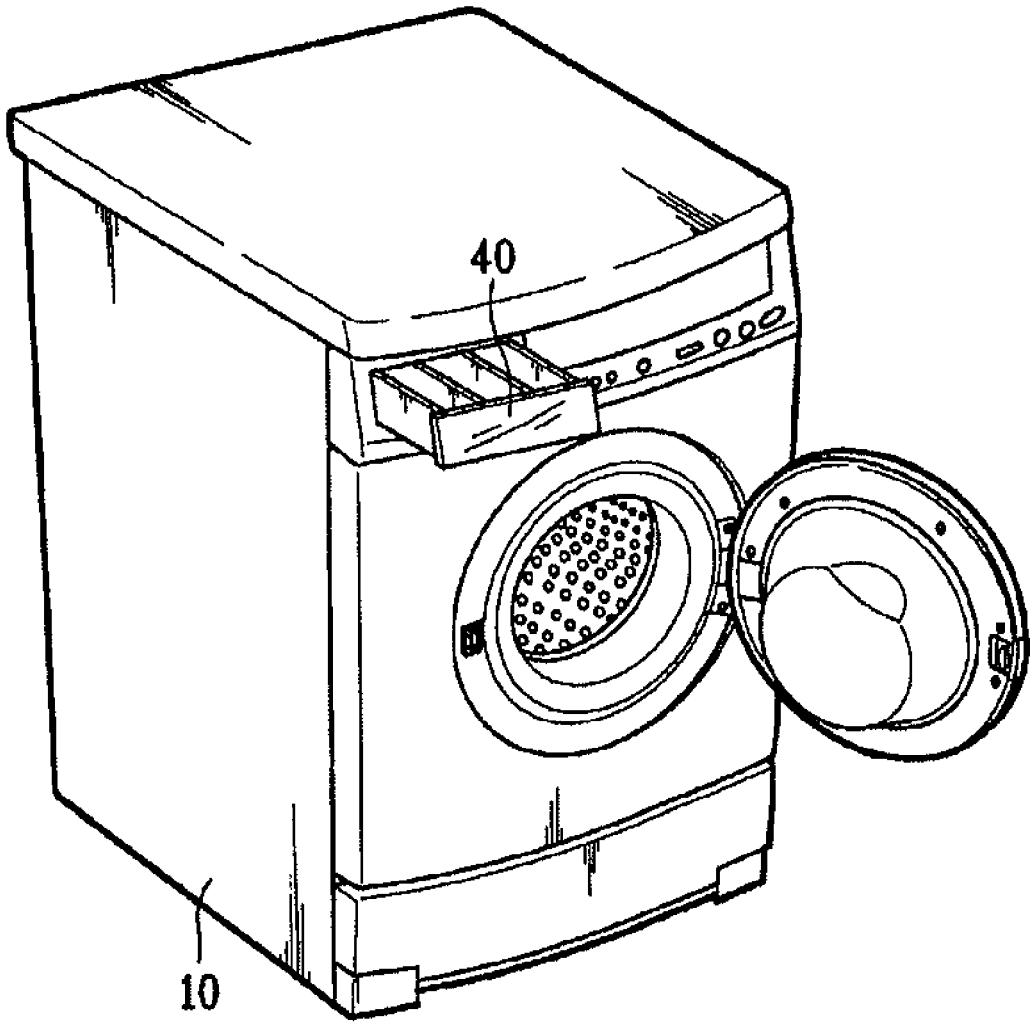
FIG. 1 PRIOR ART
FIG. 1 is a perspective view illustrating a state where a detergent container of a detergent supply apparatus installed in a general drum laundry machine is taken out.
Figure 2:
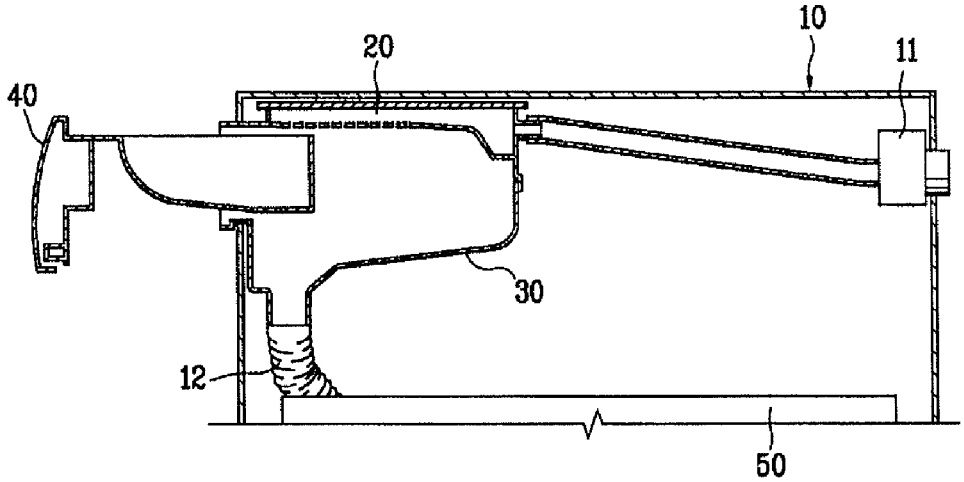
FIG.2 PRIOR ART
FIG. 2 is a schematic vertical-sectional view illustrating a structure of the detergent supply apparatus shown in FIG. 1.
Figure 3:
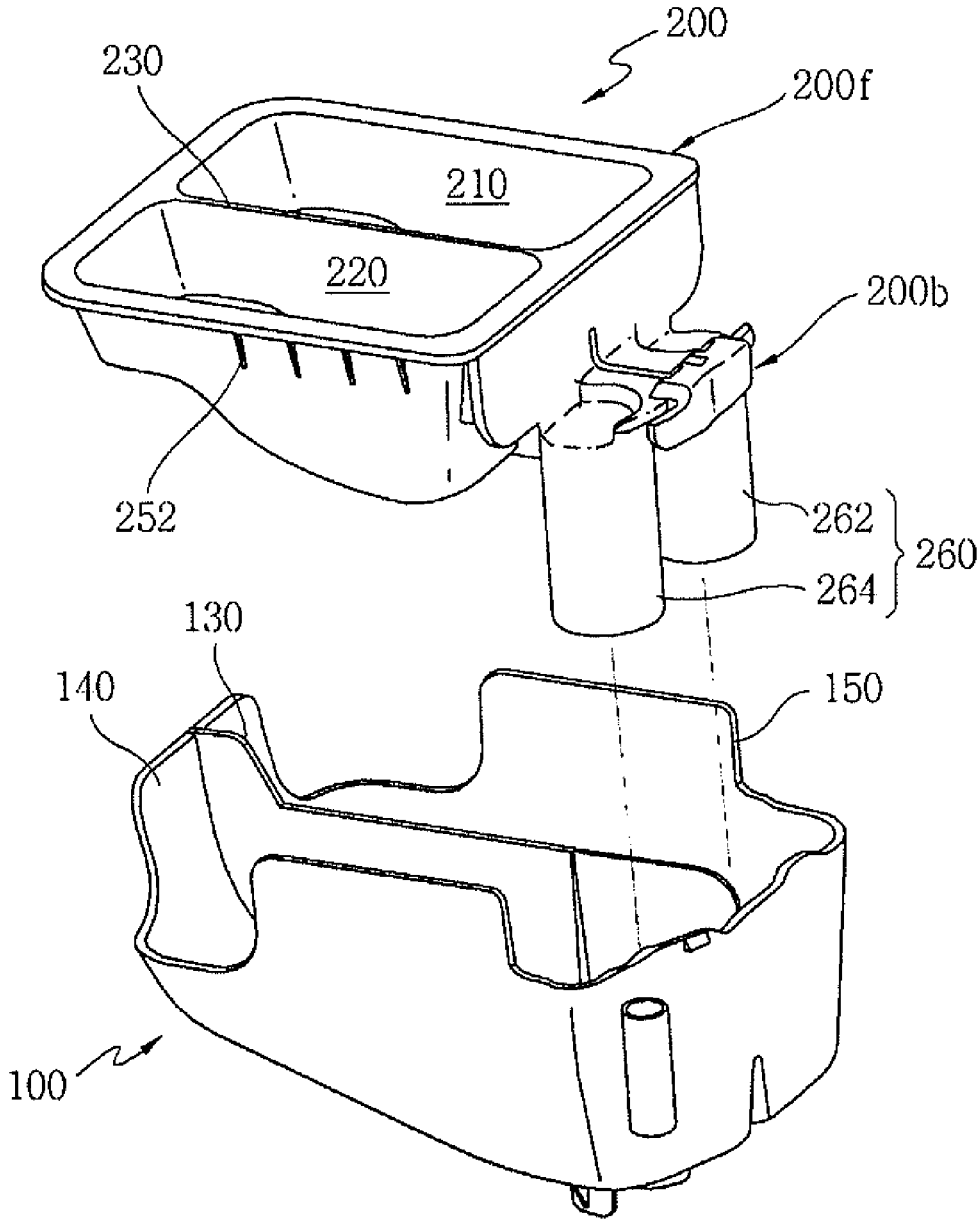
FIG. 3 is an exploded perspective view illustrating a fluid detergent and fabric softener box assembly according to an embodiment of the present invention.
Figure 4:
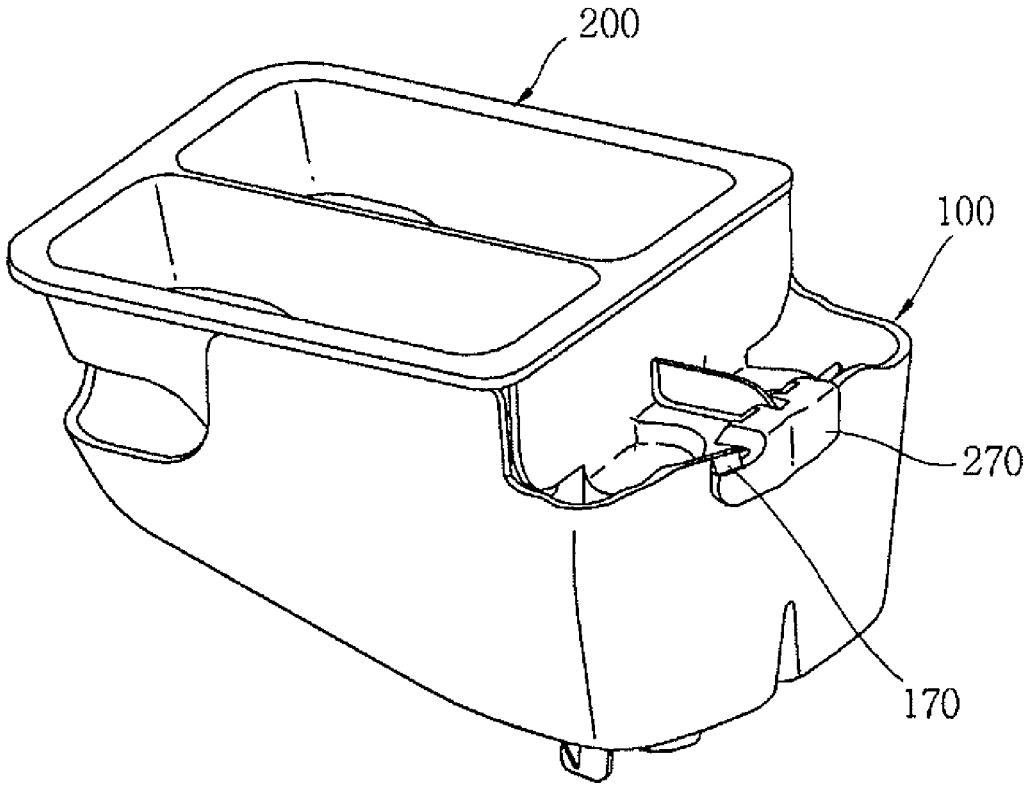
FIG. 4 is an assembled view illustrating the fluid detergent and fabric softener box assembly according to the embodiment of the present invention.
Figure 5:
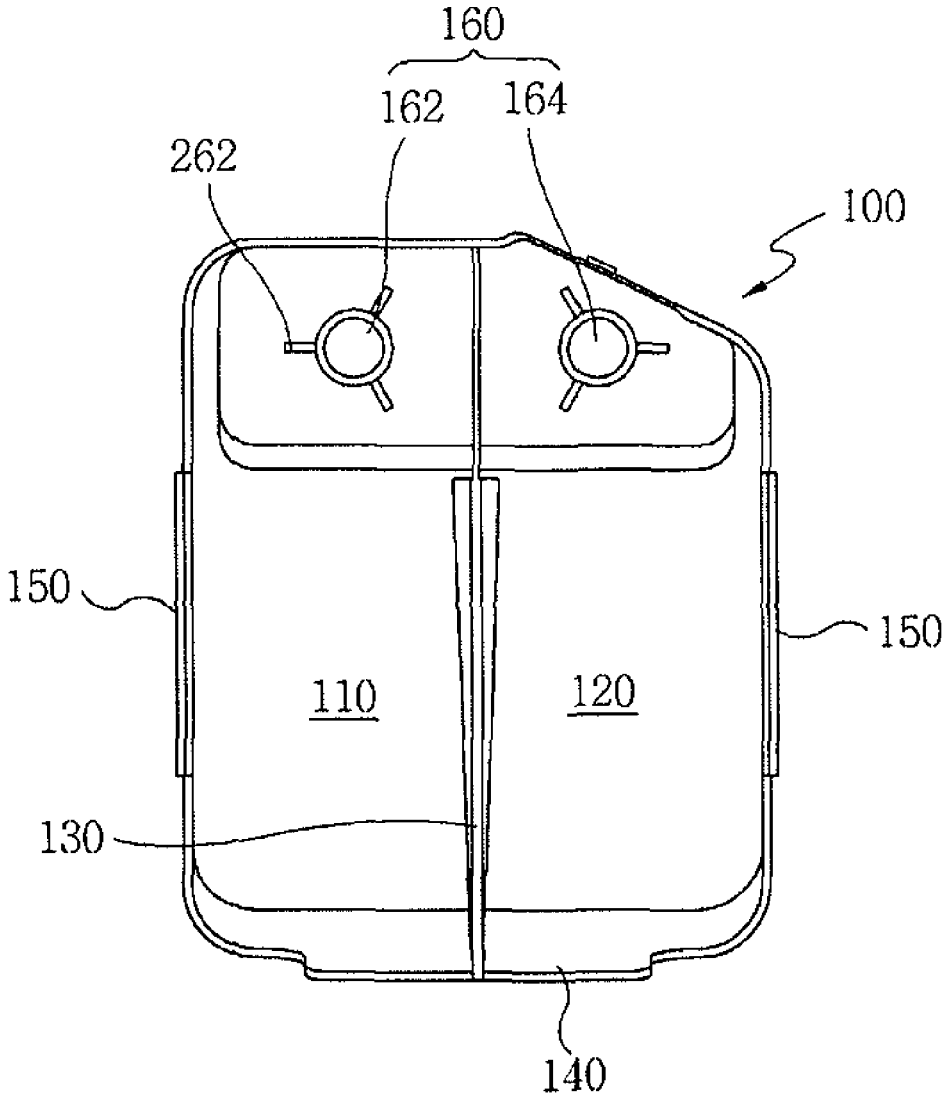
FIG. 5 is a top view illustrating a main body.
Figure 6:
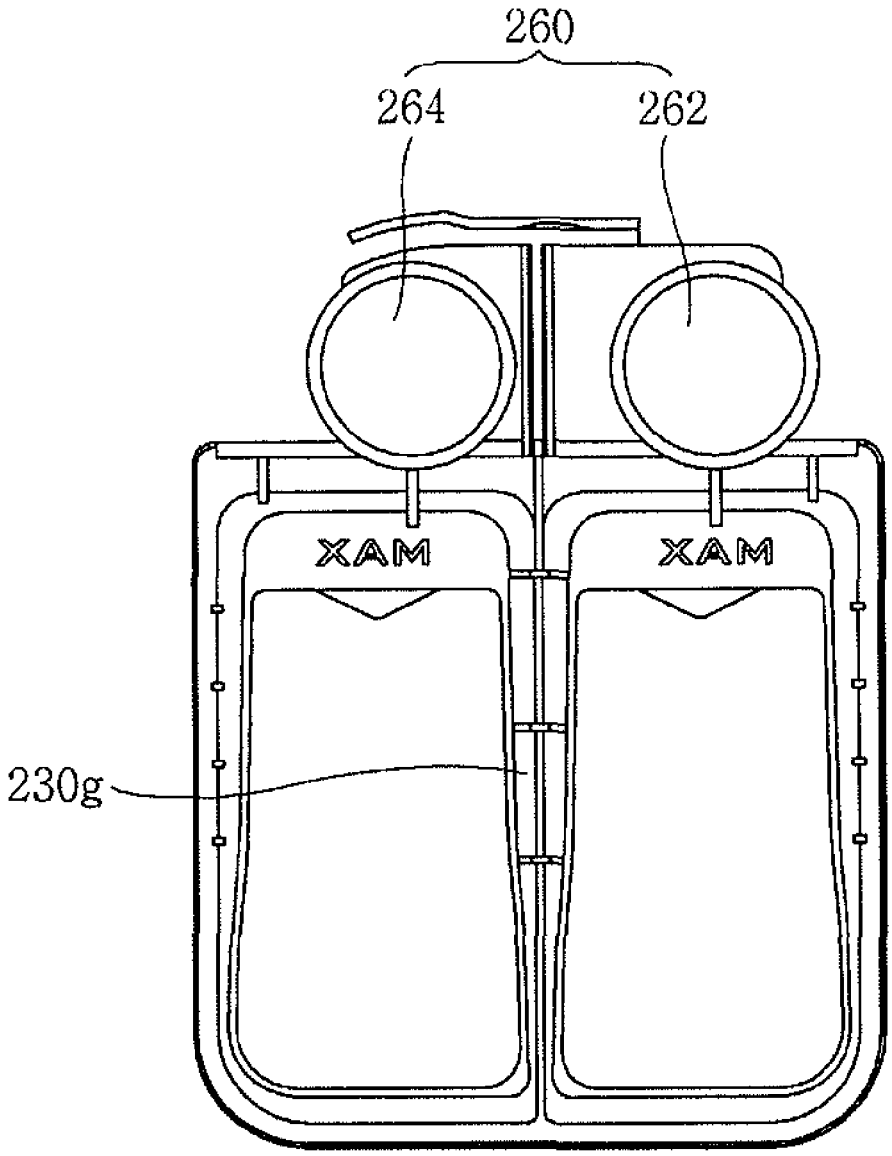
FIG. 6 is a bottom view illustrating a cap.
Figure 7:
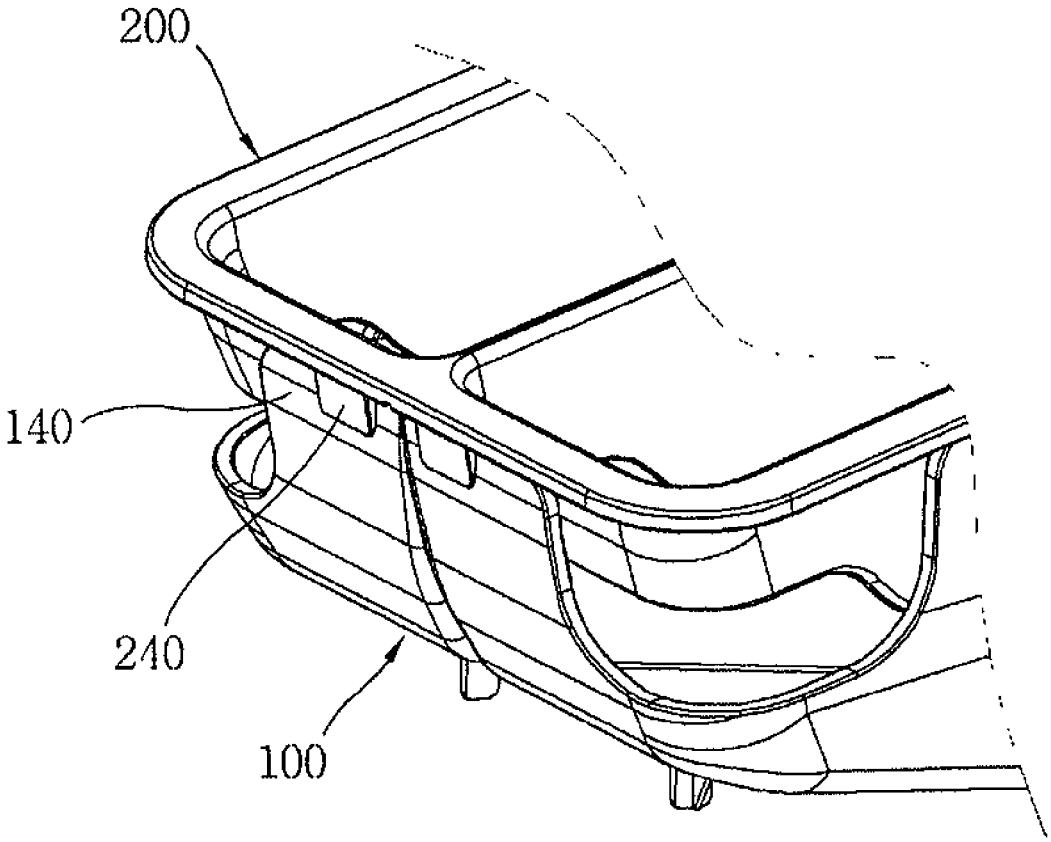
FIG. 7 is a view illustrating a front coupled portion of the cap and the main body.
Figure 8:
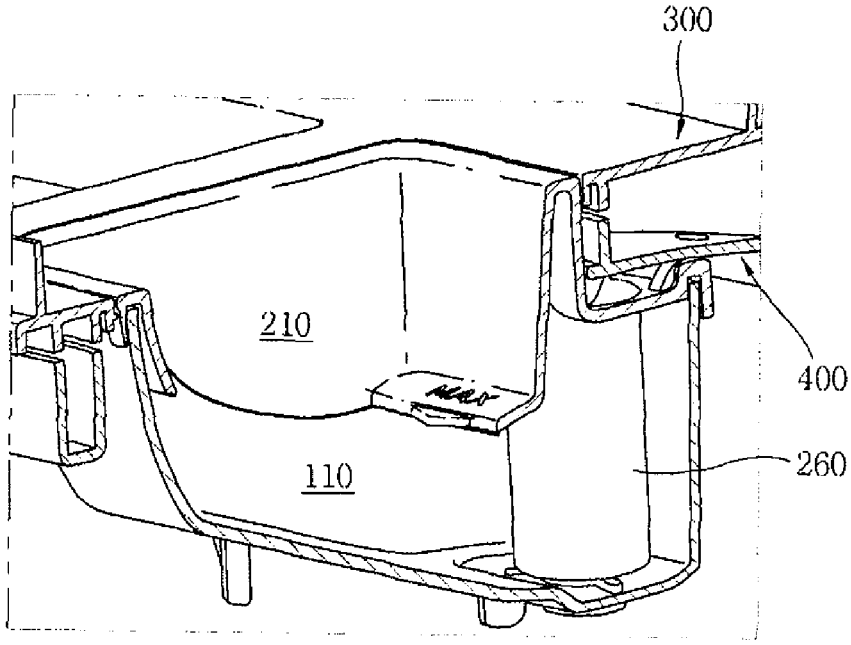
FIG. 8 is a rear cut perspective view illustrating the fluid detergent and fabric softener box assembly according to the present invention.
Figure 9:
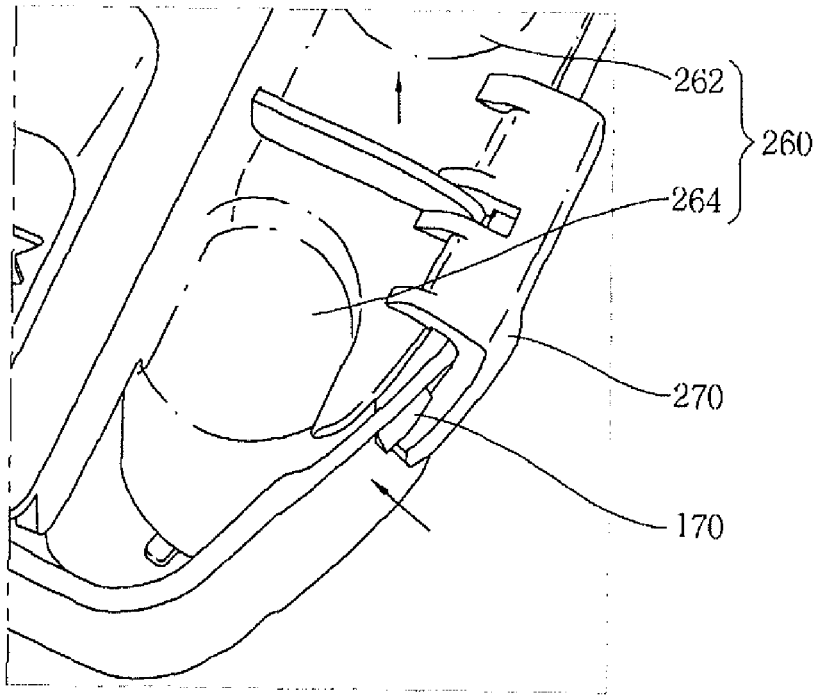
FIG. 9 is a view illustrating a rear coupled portion of the cap and the main body of the fluid detergent and fabric softener box assembly, when seen from the top.

FIG. 3 is an exploded perspective view illustrating a fluid detergent and fabric softener box assembly according to an embodiment of the present invention, FIG. 4 is an assembled view illustrating the fluid detergent and fabric softener box assembly according to the embodiment of the present invention, FIG. 5 is a top view illustrating a main body, FIG. 6 is a bottom view illustrating a cap, FIG. 7 is a view illustrating a front coupled portion of the cap and the main body, FIG. 8 is a rear cut perspective view illustrating the fluid detergent and fabric softener box assembly according to the present invention, and FIG. 9 is a view illustrating a rear coupled portion of the cap and the main body of the fluid detergent and fabric softener box assembly, when seen from the top.

The fluid detergent and fabric softener box assembly according to the embodiment of the present invention includes a main body 100 storing a fluid detergent and a fabric softener, and a cap 200 coupled to an upper portion of the main body 100. The main body 100 has an inclined bottom surface. As a whole, the depth of the main body 100 increases from the front to the rear. Here, when a user sees a dispenser from a drum laundry machine, the side near to the user is referred to as the front, and the side distant from the user is referred to as the rear. A storage space defined in the main body 100 is partitioned into a fluid detergent storage space 110 and a fabric softener storage space 120 by a barrier 130. In addition, the main body 100 includes a front seating portion 140 and side seating portions 150 to fix a position of the cap 200 and support the cap 200, when the cap 200 is coupled to the main body 100. Front seating protrusions 240 of the cap 200 discussed later are fitted onto the front seating portion 140. Moreover, since the depth of the main body 100 decreases toward the front, the height of the barrier 130 also decreases, so the intensity of the barrier 130 may be weakened at the front. However, according to the embodiment of the present invention, since the barrier 130 can be formed as high as the front seating portion 140 at the front, the intensity of the barrier 130 can be improved.

Also, pipes 160 (162 and 164) which provide passages for sucking a mixed solution of the fluid detergent and water or a mixed solution of the fabric softener and water so as to introduce the same into a wash tub are formed at the rear of the fluid detergent storage space 110 and the fabric softener storage space 120 of the main body 100, respectively. The pipes 160 are covered with pipe covers 260 of the cap 200 discussed later at a defined interval. The mixed solutions in the storage spaces 110 and 120 are sucked through the intervals between the pipes 160 and the pipe covers 260, and discharged to the wash tub side.

The cap 200 is coupled to the upper portion of the main body 100 so as to prevent the fabric softener or the fluid detergent from being splashed and mixed with each other due to a fall head of water, when water is supplied to the main body 100, or prevent the same from overflowing into another storage space 110 or 120. The cap 200 is roughly divided into a front portion **200*f* positioned at the front to cover front portions of the fluid detergent storage space 110 and the fabric softener storage space 120 of the main body 100, respectively, and a rear portion 200*b* positioned at the rear. The rear portion 200*b* is lower than the front portion 200*f*. A stepped portion is formed between the front portion 200*f* and the rear portion 200*b*. When the box assembly is coupled to a dispenser upper cover 300, the front portion 200*f* is exposed to the outside, and the rear portion 200*b* is hidden by the dispenser upper cover 300 and thus is not seen from the outside. The front portion 200*f* is placed on the dispenser upper cover 300, and the rear portion 200*b* is positioned below a dispenser lower cover 400, particularly, below water supply holes 471 and 472 of the dispenser lower cover 400, so that water can flow thereinto. Since the rear portion 200*b* is lower than the front portion 200*f*, the rear portion 200*b* can be easily inserted through a fluid detergent and fabric softener box assembly mounting space 320 (refer to FIG. 12) of the dispenser upper cover 300, and located below the dispenser lower cover 400**.

In addition, identically to the main body 100, the front portion **200*f* positioned at the front of the cap 200 is partitioned into a fluid detergent-side cap 210 and a fabric softener-side cap 220 by a barrier 230. A lower portion of the barrier 230 of the cap 200 forms a groove 230*g*, so that the barrier 130 of the main body 100 can be inserted into the groove 230*g*. The front seating protrusions 240 are formed at the front of the cap 200. The front seating protrusions 240 are downwardly extended from the fluid detergent-side cap 210 and the fabric softener-side cap 220 at a defined interval therefrom. The front seating portion 140 of the main body 100** is inserted into this interval.

Moreover, the cap 200 has side fixing ribs 252 on its side surfaces. The height of the side fixing ribs 252 slightly increases toward the upper side. The side fixing ribs 252 serve to tightly engage the cap 200 with the side seating portions 150 of the main body 100.

Further, the rear portion **200*b* positioned at the rear of the cap 200 includes the pipe covers 260 which cover the pipes 160 of the main body 100, and a rear fixing hook 270. Here, the pipe 160 of the main body 100 has cover fixing protrusions 162 at its lower portion so as to fix the pipe cover 260. The fixing protrusions 162 are provided in a plural number at certain intervals along the circumference of the pipe 160. At this time, an inner diameter of the pipe cover 260 is slightly larger than an outer diameter of the pipe 160, and a top surface of the pipe cover 260 is formed at a certain interval from a top surface of the pipe 160 of the main body 100. Accordingly, the fluid detergent mixed water or the fabric softener mixed water flows into a gap between the inner diameter of the pipe cover 260 and the pipe 160, and is introduced into a washing room through the pipe 160. Water used to produce the fluid detergent mixed water or the fabric softener mixed water is supplied from the dispenser upper cover 300 to the fluid detergent storage space 110 or the fabric softener storage space 120 of the main body 100, particularly, to open side surfaces which are not covered by the pipe covers 260 of the cap 200. In this construction, top surfaces of portions near to the barrier 130 which separates the fluid detergent storage space 110 from the fabric softener storage space 120 are covered with the pipe covers 260, so water is supplied into the storage spaces 110 and 120 through side surfaces distant from the barrier 130, i.e., outer side surfaces of the main body 100. It is thus possible to considerably prevent the fluid detergent and the fabric softener from being splashed into another storage space 110 and 120 due to a fall head of water in preparation of mixed water, or prevent bubbles which may be generated in preparation of fluid detergent mixed water from overflowing into the fabric softener storage space 120**.

Meanwhile, bottom ends of the pipes 160 of the main body 100 are positioned slightly lower than bottom surfaces of the storage spaces 110 and 120 of the main body 100. As a result, the fluid detergent mixed water or the fabric softener mixed water can be introduced into the washing room by a siphon effect without remaining in the storage space 110 or 120.

In addition, the cap 200 has the rear fixing hook 270 at the rear of the pipe covers 260, and the main body 100 has rear fixing protrusions 170 in a position corresponding thereto. The main body 100 and the cap 200 are firmly fixed by the rear fixing protrusions 170 and the rear fixing hook 270, and the rear fixing hook 270 is prevented from being upwardly lifted by the rear fixing protrusions 170. Here, preferably, the pipe covers 260 which are near to the rear fixing protrusions 170 have a slight interval from a rear surface of the main body 100. In order to separate the cap 200 from the main body 100, the user slightly pushes the main body 100 to the front, and unhooks the rear fixing hook 270 from the rear fixing protrusion 170, thereby easily separating the cap 200 from the main body 100.

In the meantime, the fluid detergent and fabric softener box assembly according to the present invention can be attached and detached to/from the dispenser. As set forth herein, since the portion hidden below the dispenser upper cover 300 and the portion exposed to the outside are formed with the stepped portion, the fluid detergent and fabric softener box assembly can be position-fixed in the dispenser. As the fluid detergent and fabric softener box assembly according to the present invention is detachably formed, the user can separate the box assembly from the dispenser and clean the box assembly, thereby maintaining cleanliness. Moreover, since the main body 100 and the cap 200 can be separated from each other, the user can easily clean the pipes 160 or the pipe covers 260 for bringing the siphon effect.

Figure 10:
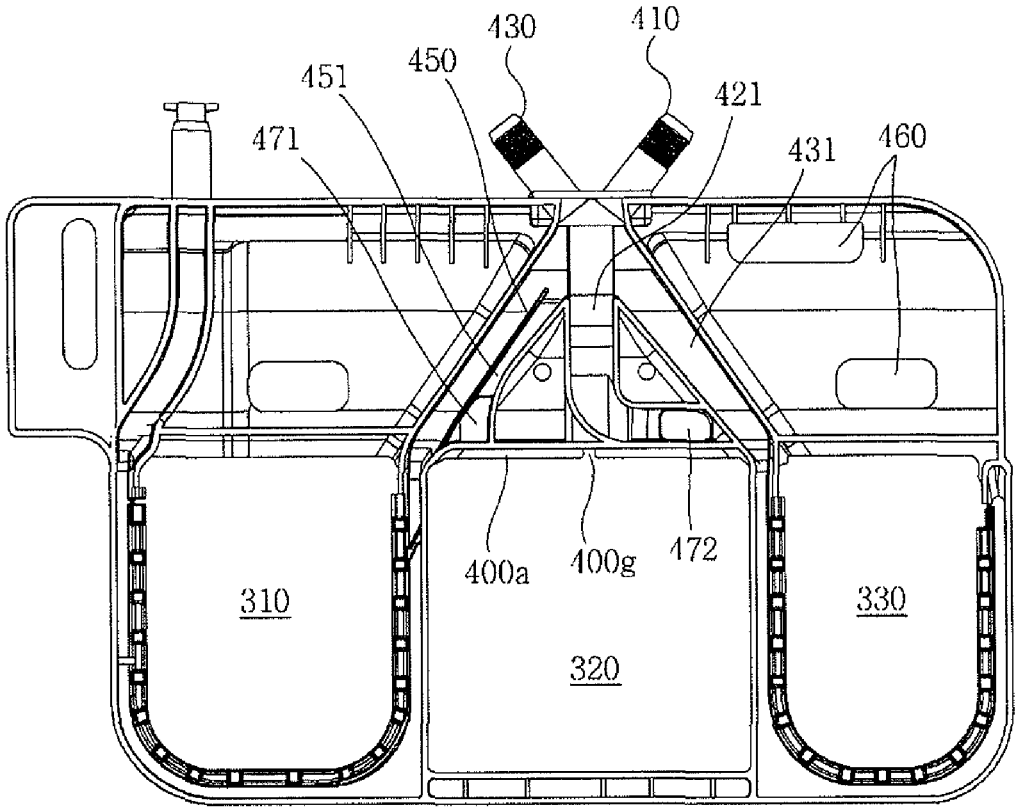
FIG. 10 is a view illustrating a top surface of a dispenser lower cover according to the embodiment of the present invention.
Figure 11:
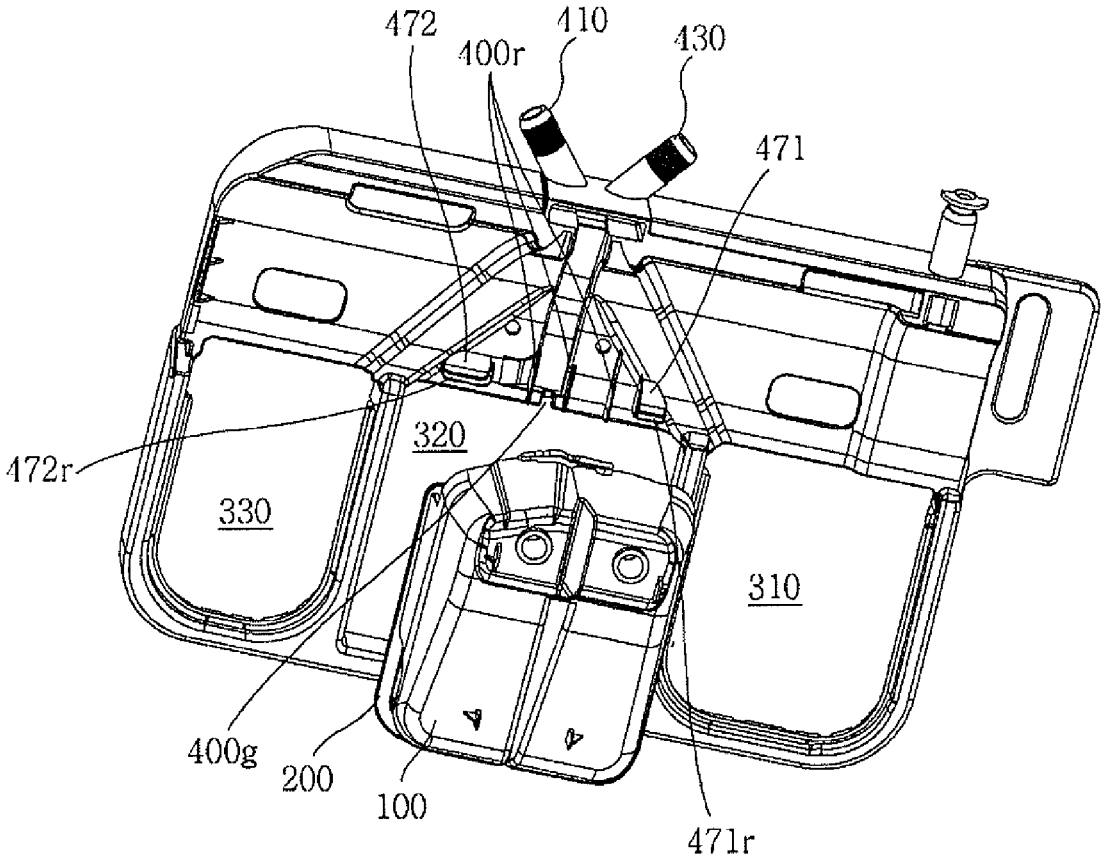
FIG. 11 is a view illustrating a bottom surface of the dispenser lower cover according to the embodiment of the present invention.

FIG. 10 is a view illustrating a top surface of the dispenser lower cover 400 according to the embodiment of the present invention, and FIG. 11 is a view illustrating a bottom surface of the dispenser lower cover 400 according to the embodiment of the present invention. The dispenser lower cover 400 includes holes for a region 310 into which a main washing detergent is introduced, a region 320 on which the fluid detergent and fabric softener box assembly is mounted, and a region 330 into which a primary washing detergent is introduced, and water supply inlets 410, 430 and 440 for supplying water to the respective regions. In addition, a passage 451 for fluid detergent which guides water from the water supply inlets 410 and 430, which supply water to the fluid detergent and fabric softener box assembly, to the water supply hole 471 for fluid detergent is formed on the top surface of the dispenser lower cover 400, and a distribution rib 450 which distributes the water supplied through the water supply inlet 410 to the passage 451 for fluid detergent and a passage for main washing detergent is also formed thereon. The water supplied through the water supply inlet 410 is supplied to the fluid detergent storage space 110 of the fluid detergent and fabric softener box assembly through the water supply hole 471 for fluid detergent along the passage 451 for fluid detergent. Moreover, water supplied through the water supply inlets 410 and 430 to introduce the fabric softener is supplied to the fabric softener storage space 120 of the fluid detergent and fabric softener box assembly through the water supply hole 472 for fabric softener along a passage 421 for fabric softener.

Here, in order to prevent the fabric softener from being introduced into the washing room early because the water supplied through the water supply inlet 410 is splashed against the distribution rib 450, it is necessary to restrict a shape of an end of the distribution rib 450. A height of an endmost portion of the end of the distribution rib 450 on the side of the water supply inlet 410 is restricted to within 3.5 mm, and the height smoothly and gradually increases from the endmost portion to about 15 mm. That is, a length of a chamfered portion of the end of the distribution rib 450 is preferably over at least 15 mm. As the end of the distribution rib 450 is smoothly formed, the water supplied through the water supply inlet 410 is not splashed against the distribution rib 450.

In addition, when water is supplied to the fluid detergent storage space 110 through the water supply inlet 410, if the supplied water overflows into the fabric softener storage space 120 or bubbles of the fluid detergent overflow into the fabric softener storage space 120, the fabric softener may be introduced early or diluted. In order to prevent the foregoing problem, a plurality of ribs 400*r* are formed on the bottom surface of the dispenser lower cover 400 facing the rear portion of the fluid detergent and fabric softener box assembly. The ribs 400*r* can more or less prevent water from flowing from the fluid detergent storage space 110 to the fabric softener storage space 120 or from the fabric softener storage space 120 to the fluid detergent storage space 110. Moreover, a water supply hole rib 471*r* for fluid detergent and a water supply hole rib 472*r* for fabric softener which guide water in water supply to prevent splashing are formed in the water supply hole 471 for fluid detergent and the water supply hole 472 for fabric softener. Like the ribs 400*r*, the water supply hole rib 471*r* for fluid detergent and the water supply hole rib 472*r* for fabric softener can prevent overflowing of the bubbles of the fluid detergent.

Further, the dispenser lower cover 400 includes a groove 400*g* so that the barrier 130 of the main body 100 of the fluid detergent and fabric softener box assembly can be inserted thereinto. The groove 400*g* is necessary to insert the rear portion of the fluid detergent and fabric softener box assembly into the lower portion of the dispenser lower cover 400. Furthermore, as the barrier 130 is engaged with the groove 400*g*, the fluid detergent and fabric softener box assembly can be position-fixed to some extent. Still furthermore, the dispenser lower cover 400 includes a rib 400*a* slightly protruding into the region 320 on which the fluid detergent and fabric softener box assembly is to be mounted, and the groove 400*g* is formed in the rib 400*a*. The reason is that it is much easier to bore the groove 400*g* in the rib 400*a* than in a wall. Still furthermore, since the ribs 400*r* can be extended toward the rib 400*a*, it is possible to efficiently prevent overflowing of the bubbles of the fluid detergent.

Figure 12:
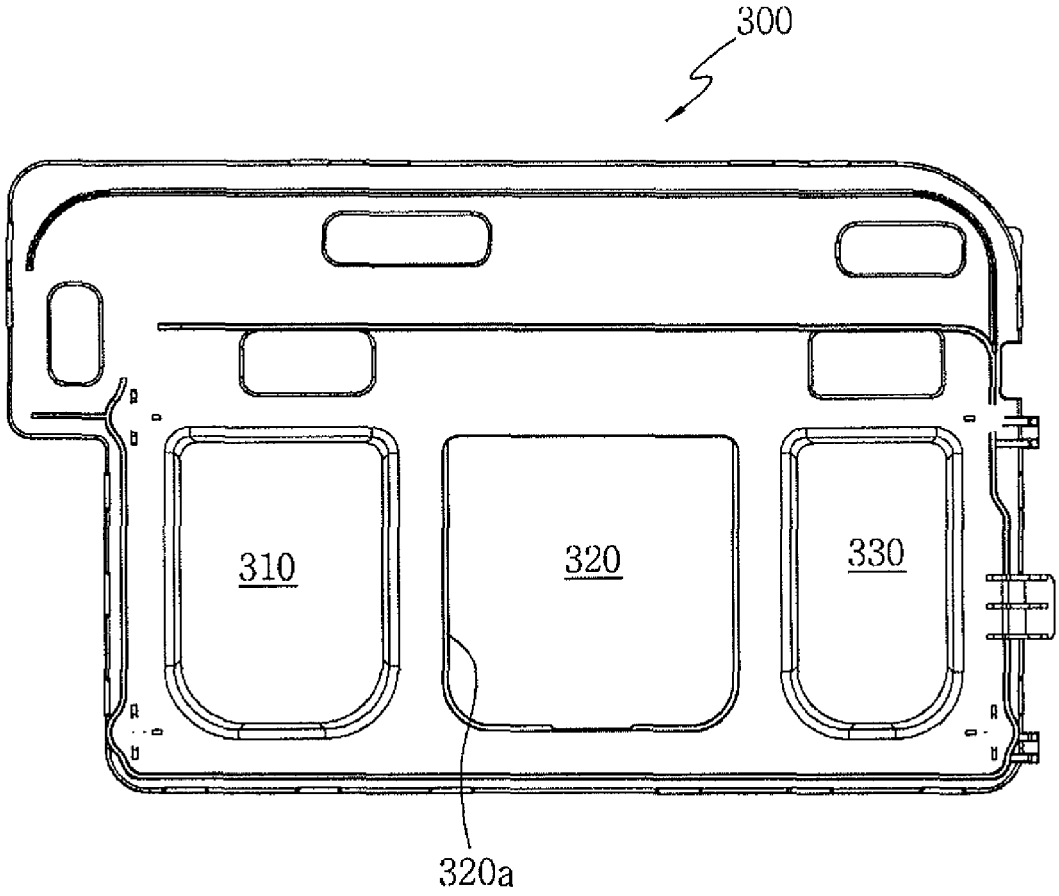
FIG. 12 is a view illustrating a top surface of a dispenser upper cover according to the embodiment of the present invention.
Figure 13:
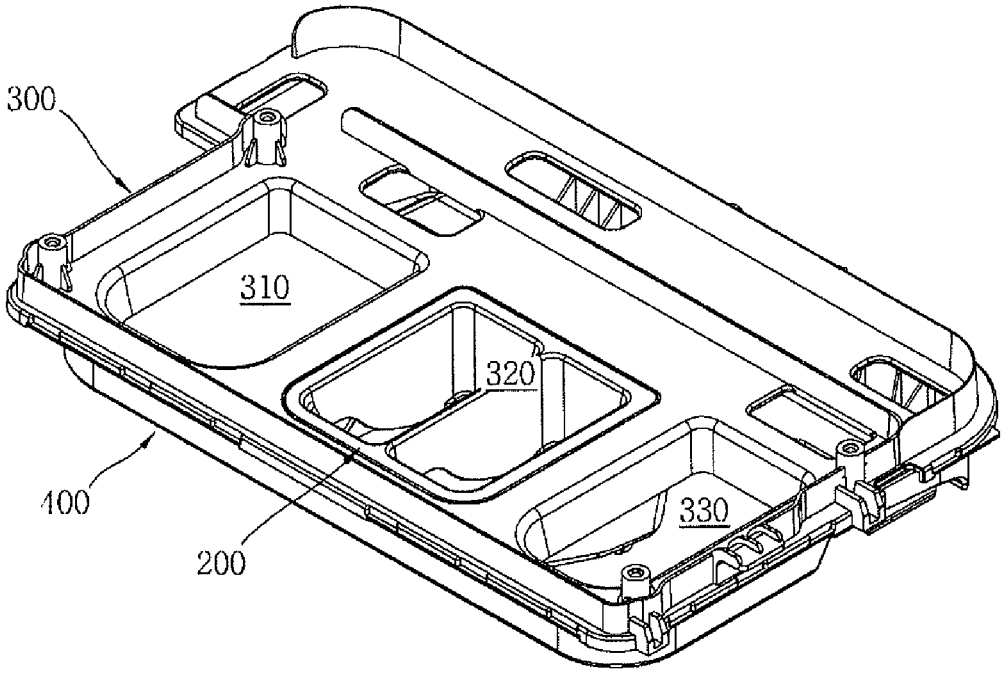
FIG. 13 is a view illustrating a state where the fluid detergent and fabric softener box assembly is mounted on the dispenser according to the embodiment of the present invention.

FIG. 12 is a view illustrating a top surface of the dispenser upper cover according to the embodiment of the present invention, and FIG. 13 is a view illustrating a state where the fluid detergent and fabric softener box assembly is mounted on a dispenser cover formed by coupling the dispenser upper cover to the dispenser lower cover. The dispenser upper cover 300 is coupled to the dispenser lower cover 400, has passage shapes corresponding to those of the dispenser lower cover 400, and prevents overflowing or splashing of water introduced along the passages. In addition, the dispenser upper cover 300 includes holes for the region 310 into which the main washing detergent is 5 introduced, the region 320 on which the fluid detergent and fabric softener box assembly is mounted, and the region 330 into which the primary washing detergent is introduced in positions corresponding to the dispenser lower cover 400. When the fluid detergent and fabric softener box assembly is mounted on the dispenser cover, only the front portion 200*f* of the cap 200 is exposed to the top surface of the dispenser upper cover 300. As described above, the fluid detergent and fabric softener box assembly can be mounted or taken out through the hole for the region 320 of the dispenser upper cover 300 on which the fluid detergent and fabric softener box assembly is mounted. When the user grasps the barrier 230 of the fluid detergent and fabric softener box assembly and inserts Is the rear portion 200*b* first through the hole of the dispenser upper cover 300, some portion of the barrier 130 of the main body 100 is engaged with the groove 400*g* of the dispenser lower cover 400. Moreover, the dispenser upper cover 300 has a rib 320*a* protruding into the hole around the hole. The side surfaces of the front portion 200*f* of the fluid detergent and fabric softener box assembly are placed on the rib 320*a*. Accordingly, the fluid detergent and fabric softener box assembly is not inserted more deeply into the region 320 on which the fluid detergent and fabric softener box assembly is mounted, but position-restricted.

Although the present invention has been described in detail in connection with the embodiment and the accompanying drawings, the scope of the invention is not limited thereto, but is defined by the appended claims.

What is claimed is:

1. A detergent dispenser for a drum type laundry machine, comprising:

a dispenser cover which is formed by coupling a dispenser lower cover to a dispenser upper cover, and includes a region into which a main washing detergent is introduced, a region on which a fluid detergent and fabric softener box assembly is mounted, and a region into which a primary washing detergent is introduced; and a fluid detergent and fabric softener box assembly which is detachably coupled to the dispenser cover which comprises a main body partitioned into a fluid detergent storage space and a fabric softener storage space by a barrier to store a fluid detergent and a fabric softener, and a cap partitioned by a barrier, and attached and detached to/from an upper portion of the main body, wherein the dispenser lower cover comprises a water supply inlet through which water is supplied from the outside, drainage holes which supply water to each region, passages which guide water supplied to each drainage hole, and a distribution rib which distributes water to each passage, wherein an end of the distribution rib on the side of the water supply inlet is smoothly formed and therefore the water supplied through the water supply inlet is not splashed against the distribution rib.

2. The detergent dispenser of claim 1, wherein the main body comprises pipes capable of discharging mixed water, in which water supplied to a rear of the main body is mixed with the fluid detergent or the fabric softener, into a washing room.

3. The detergent dispenser of claim 2, wherein a bottom end of each pipe of the main body is positioned lower than bottom surfaces of storages spaces into which the fluid detergent and the fabric softener are introduced.

4. The detergent dispenser of claim 2, wherein the cap comprises pipe covers which cover an upper portion of each pipe at a defined interval from each pipe.

5. The detergent dispenser of claim 4, wherein water used to produce fluid detergent mixed water or fabric softener mixed water is supplied to open side surfaces at the rear of the cap which are not covered with the pipe covers.

6. The detergent dispenser of claim 1, wherein the barrier of the cap comprises a groove so that the barrier of the main body can be inserted thereinto.

7. The detergent dispenser of claim 1, wherein a stepped portion is formed between a front portion and a rear portion of the cap, and the front portion of the cap is higher than the rear portion thereof.

8. The detergent dispenser of claim 7, wherein the dispenser upper cover comprises a rib so that the front portion of the cap can be hooked thereon and fixed thereto, when the fluid detergent and fabric softener box assembly is coupled to the dispenser cover.

9. The detergent dispenser of claim 7, wherein, when the fluid detergent and fabric softener box assembly is coupled to the dispenser cover, the rear portion of the cap is positioned below the dispenser lower cover.

10. The detergent dispenser of claim 1, wherein a seating protrusion is formed at a front of the cap so that a front portion of the main body can be fitted thereto.

11. The detergent dispenser of claim 1, wherein a fixing hook is provided at a rear of the cap, and a fixing protrusion which fixes the fixing hook is provided at a rear of the main body.

12. The detergent dispenser of claim 1, wherein a height of an endmost portion of the end of the distribution rib on the side of the water supply inlet is restricted to within 3.5 mm, and the height smoothly and gradually increases from the endmost portion to about 15 mm.

13. The detergent dispenser of claim 1, wherein the dispenser lower cover comprises a fluid detergent-side drainage hole and a fabric softener-side drainage hole in the region on which the fluid detergent and fabric softener box assembly is mounted, and also comprises a plurality of ribs between the respective drainage holes.

14. The detergent dispenser of claim 1, wherein the dispenser lower cover comprises a fluid detergent-side drainage hole and a fabric softener-side drainage hole in the region on which the fluid detergent and fabric softener box assembly is mounted, and also comprises a rib for guiding water around each drainage hole.

15. The detergent dispenser of claim 1, wherein the dispenser lower cover comprises a groove so that the barrier of the main body can be inserted thereinto.

* * * * *